US011173585B2

(12) United States Patent
Gauthier et al.

(10) Patent No.: US 11,173,585 B2
(45) Date of Patent: Nov. 16, 2021

(54) SHAFT SECURING MECHANISM

(71) Applicant: Gauthier Biomedical, Inc., Grafton, WI (US)

(72) Inventors: Michael T. Gauthier, Grafton, WI (US); Ray Wollner, Kewaskum, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 253 days.

(21) Appl. No.: 15/651,128

(22) Filed: Jul. 17, 2017

(65) Prior Publication Data

US 2018/0015597 A1 Jan. 18, 2018

Related U.S. Application Data

(60) Provisional application No. 62/362,817, filed on Jul. 15, 2016.

(51) Int. Cl.
*B25B 23/00* (2006.01)
*B25G 3/02* (2006.01)
*B25B 15/02* (2006.01)

(52) U.S. Cl.
CPC ..... *B25B 23/0007* (2013.01); *B25B 15/02* (2013.01); *B25B 23/0035* (2013.01); *B25B 23/0042* (2013.01); *B25G 3/02* (2013.01)

(58) Field of Classification Search
CPC . B25B 15/02; B25B 23/0007; B25B 23/0035; B25B 23/0042
USPC ..... 81/177.1, 438
See application file for complete search history.

(56) References Cited

U.S. PATENT DOCUMENTS 5,207,697 A * 5/1993 Carusillo ..... A61B 17/1626 320/115
7,726,664 B2 * 6/2010 Peters ..... B23B 31/005 279/143
2004/0267267 A1 * 12/2004 Daniels ..... A61F 2/3662 606/80
2007/0152408 A1 * 7/2007 Peters ..... B23B 31/107 279/143
2008/0275449 A1 * 11/2008 Sackett ..... A61B 17/1668 606/80
2013/0310866 A1 * 11/2013 Belagali ..... B23B 31/1074 606/180
2017/0348831 A1 * 12/2017 Lin ..... B25B 23/0035
2018/0200068 A1 * 7/2018 Goldberg ..... A61F 2/30771

* cited by examiner

*Primary Examiner* — David B. Thomas
(74) *Attorney, Agent, or Firm* — Boyle Fredrickson S.C.

(57) ABSTRACT

A shaft securing mechanism is provided that includes pins, bearings or other securing members that are biased inwardly at an angle with respect to the axis of the shaft being engaged by the mechanism. The angled orientation of the engagement of the pins with the shaft enables the pins to more securely hold the shaft relative to the handle without significant slop or play in the lateral or longitudinal directions. The mechanism also includes a tapered inner surface to increase the ease of alignment of the shaft with the mechanism, which allows the shaft to be engaged with the handle by only pressing and rotating the shaft into the mechanism within the handle.

9 Claims, 5 Drawing Sheets

SHAFT SECURING MECHANISM

CROSS-REFERENCE TO RELATED APPLICATIONS

This application claims priority from U.S. Provisional Patent Application Ser. No. 62/362,817, filed on Jul. 15, 2016, the entirety of which is expressly incorporated by reference herein for all purposes.

FIELD OF THE INVENTION

The present invention relates generally to tools, and more specifically to a shaft securing mechanism for use in securing a shaft to the handle of a tool, such as a driving tool.

BACKGROUND OF THE INVENTION

In many types of tool structures, such as drills, wrenches and screwdrivers, among other types of tools, a shaft fastening mechanism is incorporated within the handle for the tool in order to allow the same shaft configuration utilized on a variety of implements of different types, ratcheting heads, bolt sockets, screwdriver bits, etc., to be releasably secured to the handle. The mechanism enables the shaft an implement disposed on the shaft to be securely held on the handle when the mechanism is engaged with the handle during use. The mechanism also can be quickly and easily disengaged from the shaft to allow the shaft to be removed from the handle when the shaft for a different implement is to be engaged with the handle.

In one particular prior art mechanism, such as shown in FIG. 1, in a Hudson Connector, the mechanism 100 includes a plunger 102 movably disposed within or on the handle 104 that can slide within or into the handle 104 to enable spring-biased bearings or pins 106 that extend and are located at least partially within the plunger 102 to move with respect to the plunger 102. A shaft 108 including slots or recesses 110 on the sides of the shaft 108 can then be inserted within the plunger 102 past the bearings 106 to align the recesses 110 with the bearings 106. The plunger 102 is then released and under the bias of the spring 112, the plunger 102 is urged outwardly to move the bearings 106 into the slots 110 on the shaft 108, thereby securely engaging and holding the shaft 108 on the handle 104.

However, while the Hudson connector is able to withstand high torque forces without failing and to deliver high impact using the handle via the shaft, there are a number of deficiencies with the Hudson connector.

In particular, with the Hudson connector, the shaft is able to move in both the lateral and longitudinal directions as a result of the slop in the securing mechanism 100 for the Hudson connector. This is due to the angle at which the pins or bearings 106 contact the shaft 108, which is normal to the axis of the shaft 108, and the configuration of the pin or bearings 106 used, which are cylindrical or spherical in shape, such that they contact the shaft 108 only at a point on the pin or bearing 106, limiting the force exerted on the shaft 108 other than at that specific point. As such, and in conjunction with the slots/recesses 110 in the shaft 108 being formed to be larger than the associated pin/bearing 106 to increase the ease of engagement, the shaft 108 can readily move relative to the handle 104 which is not desirable.

Further, the shafts 108 utilized with the Hudson connector 100 are formed with a flat leading edge or surface 114 designed to align the shaft 108 with the connector 100 when contacting a shoulder 116 disposed within the connector 100. When the leading edge 114 contacts the shoulder 116, the shaft 108 is then rotated to align the configuration of the leading edge 114 with the configuration of the shoulder 116 to enable the shaft 108 to be centered within the connector 100. However, as the shaft 108 must be rotated within the connector 100 to properly align the leading edge 114, this can often make the centering of the shaft 108 within the connector 100 more difficult as a result of the flatness of the leading edge 114.

Also, as a result of the configuration of the Hudson connector 100, when operated it is necessary to manually displace the plunger or collar 102 inwardly with respect to the handle 104 in order to move the pins or bearings 106 out of the path of the shaft 108 before the shaft 108 can be engaged by the mechanism 100. In various situations the ability of an individual to both hold the handle 104 and move the plunger 102 is difficult as it requires the individual be able to hold the handle 104 and move the plunger 102 with a single hand, as the other hand is holding the shaft 108 to be inserted into the handle 104.

Thus, it is desirable to develop a shaft securing mechanism that addresses these shortcomings with prior art shaft securing mechanisms.

SUMMARY OF THE INVENTION

According to one exemplary embodiment of the invention, a shaft securing mechanism is provided that includes pins, bearings or other securing members that are biased inwardly at an angle with respect to the axis of the shaft being engaged by the mechanism. The angled orientation of the engagement of the pins with the shaft enables the pins to more securely hold the shaft relative to the handle without significant slop or play in the lateral or longitudinal directions.

According to another exemplary embodiment of the invention, the connector/shaft securing mechanism includes an angled or sloped surface within the connector to assist in guiding the shaft into alignment with the center of the mechanism.

According to still another exemplary embodiment of the invention, the shaft securing mechanism is formed such that the plunger or collar can be displaced by the insertion of the shaft into the mechanism alone without the need for additional force to be exerted directly on the plunger by the user.

Numerous other aspects, features, and advantages of the present invention will be made apparent from the following detailed description together with the drawing figures.

BRIEF DESCRIPTION OF THE DRAWINGS

The drawings illustrate the best mode currently contemplated of practicing the present invention.

In the drawings.

DETAILED DESCRIPTION

Figure 1:
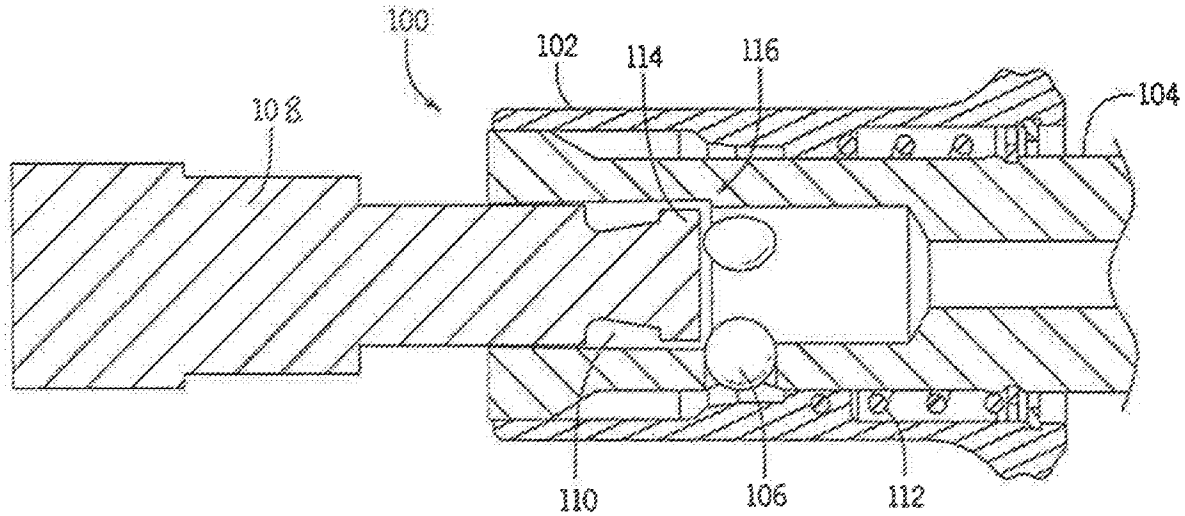
FIG. 1 PRIOR ART
FIG. 1 is a cross-sectional view of a prior art shaft securing mechanism.
Figure 2:
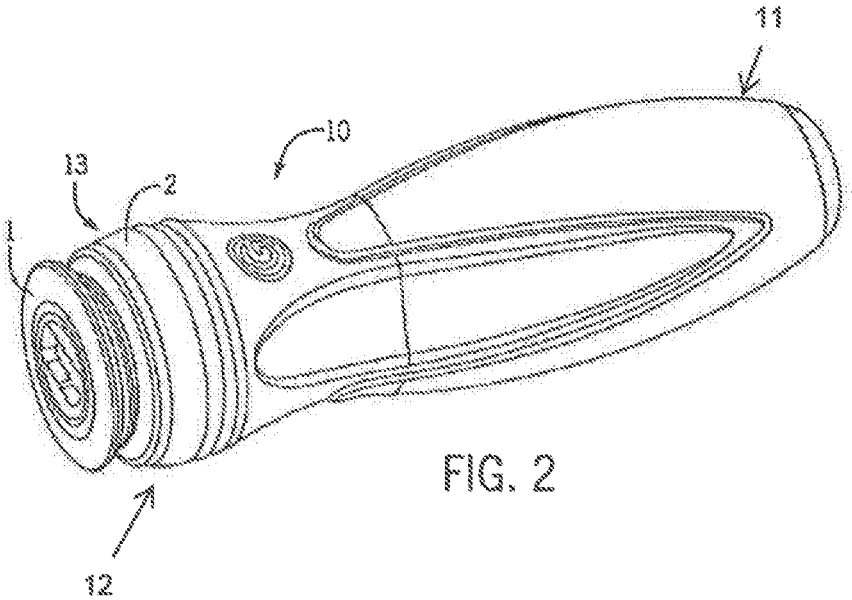
FIG. 2 is an isometric view of a handle including a shaft securing mechanism constructed according to one exemplary embodiment of the invention.

Referring now in detail to the drawing figures, wherein like reference numerals represent like parts throughout the several views, an exemplary embodiment of a tool handle 10 is illustrated in FIG. 2. The handle 10 has an in-line configuration as shown, but can have other configurations, such as a t-handle configuration, among others. The handle 10 includes a closed end 11 and an open end 12, in which the connector or shaft securing mechanism 13 is disposed.

Figure 3:
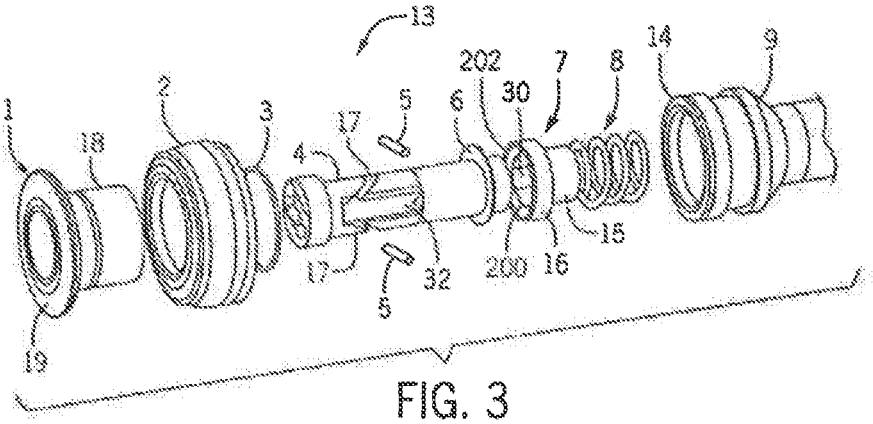
FIG. 3 is an exploded, isometric view of the shalt securing mechanism employed in the handle of FIG. 2.
Figure 4:
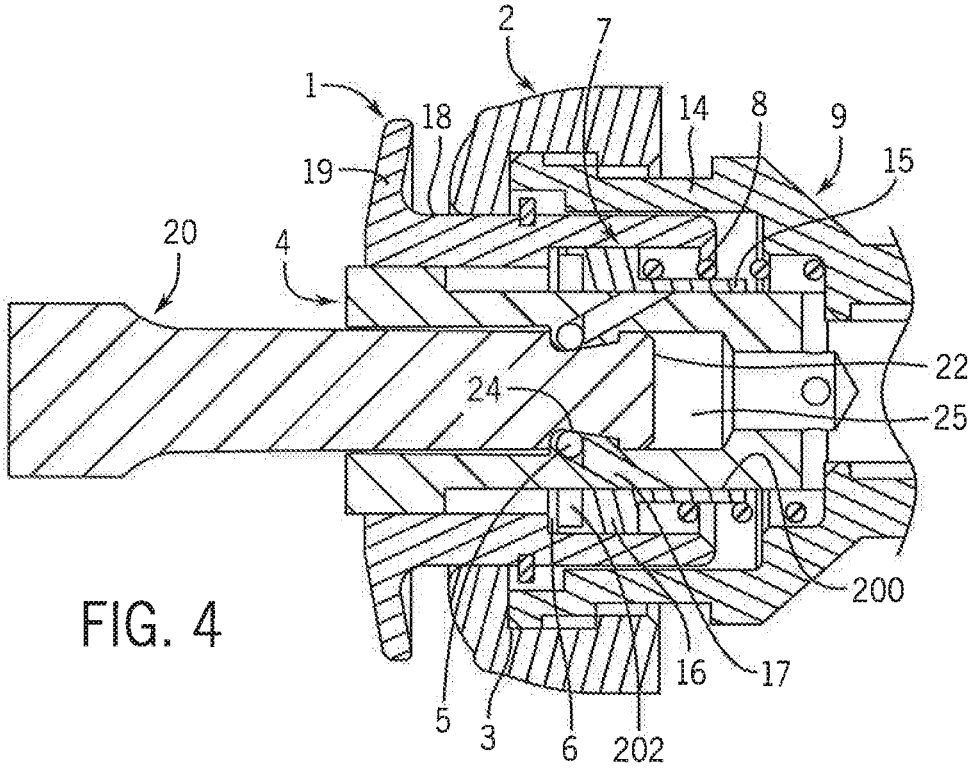
FIG. 4 is a cross-sectional view of a shaft securing mechanism constructed according to one exemplary embodiment of the invention.

Looking now at the exemplary embodiment illustrated in FIGS. 3-4, the mechanism 13 includes a handle core 9 formed of a suitable material and that is disposed within the handle 10, such as by molding the handle 10 around the handle core 9, and includes a wide open end 14, Within the wide open end 14, the mechanism 13 includes a compression spring 8 that is engaged with the interior of the core 9 at one end and with a cylindrical ring shuttle 7 at the opposite end.

The ring shuttle 7 defines a passage 200 therethrough and includes an inner portion 15 disposed within the spring 8 and an outer portion 16 engaged by the end of the spring 8 and extending outwardly from the spring 8. The ring shuttle 7 also contains a set of flats 30 disposed on opposed sides of the passage 200 that will align with corresponding flats 32 on the main body 4 to orient the shuttle 7 to the main body 4 and prevent the pins 5 from jamming. The overall length of the ring shuttle 7 prevents the spring 8 from getting stuck in the slots 17 of the main body 4. The outer portion 16 is circular in shape and engages a slide washer 6 that is disposed around the main body 4 of the mechanism 13.

The main body 4 is cylindrical in shape and extends through the washer 6 and the passage 200 in the shuttle 7 into the interior of the spring 8 and the core 9 were it is fixed to the core 9. The main body 4 includes a central bore 25 and a pair of angled slots 17 formed on opposed sides of the bore 25 within the main body 4 in which pins 5 are positioned in a manner to allow sliding of the pins 5 within the slots 17. The pins 5 are secured at opposite ends within a circumferential slot 202 formed within the interior of the outer portion 16 of the ring shuttle 7 such that the pins 5 do not move axially along the mechanism 13 but can move laterally within the ring shuttle 7 as directed by the shape of the slots 17 and movement of the main body 4. Further, the slots 17 are formed in the main body 4 to be disposed at an angle with regard to a central axis of the main body 4 extending through the main body 4 along a centerline of the bore 25 within the main body 4. The slots 17 intersect the bore 25 at their inner end and extend completely though the main body 4 to the exterior of the main body 4. In an alternative embodiment, the slots 17 can be formed to terminate within the main body 4, if desired. The pins 5 are disposed within the slots 17 such that the pins 5 are oriented perpendicularly to the length of the slots 17 extending from the exterior of the main body 4 to the bore 25 within the main body 4. This orientation of the pins 5 within the slots 17 enables the entire portion of the pin 5 exposed within the slot to contact and engage a shaft 20 in a manner to be discussed in the operation of the mechanism 13.

A release collar 1 is disposed around the ring shuttle 7 with a cylindrical section 18 located within and engaged with the wide end 14 by retaining ring 3, and an annular section 19 located outside of the handle 10. The cylindrical section 18 extends through a cover or cap 2 engaged with the wide end 14 and which forms an outer end stop for the movement of the release collar 1 with respect to the core 9 and main body 4.

Figure 6A:
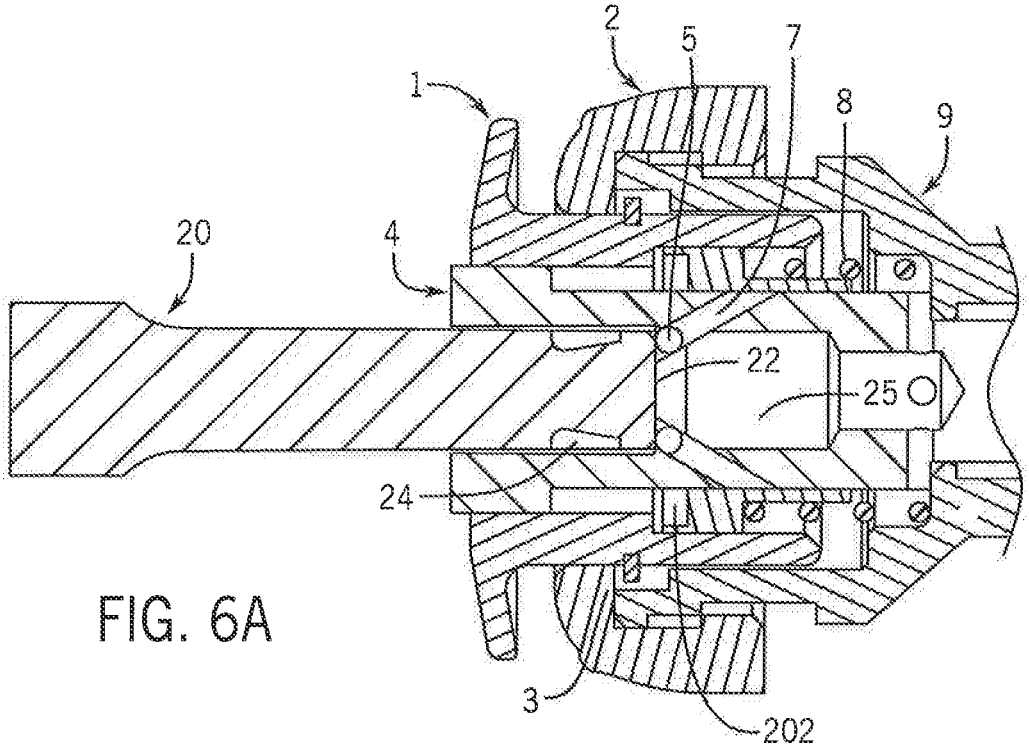
FIGS. 6A-6D are cross-sectional views of the insertion of a shaft into a shaft securing mechanism according to still another exemplary embodiment of the invention.
Figure 6B:
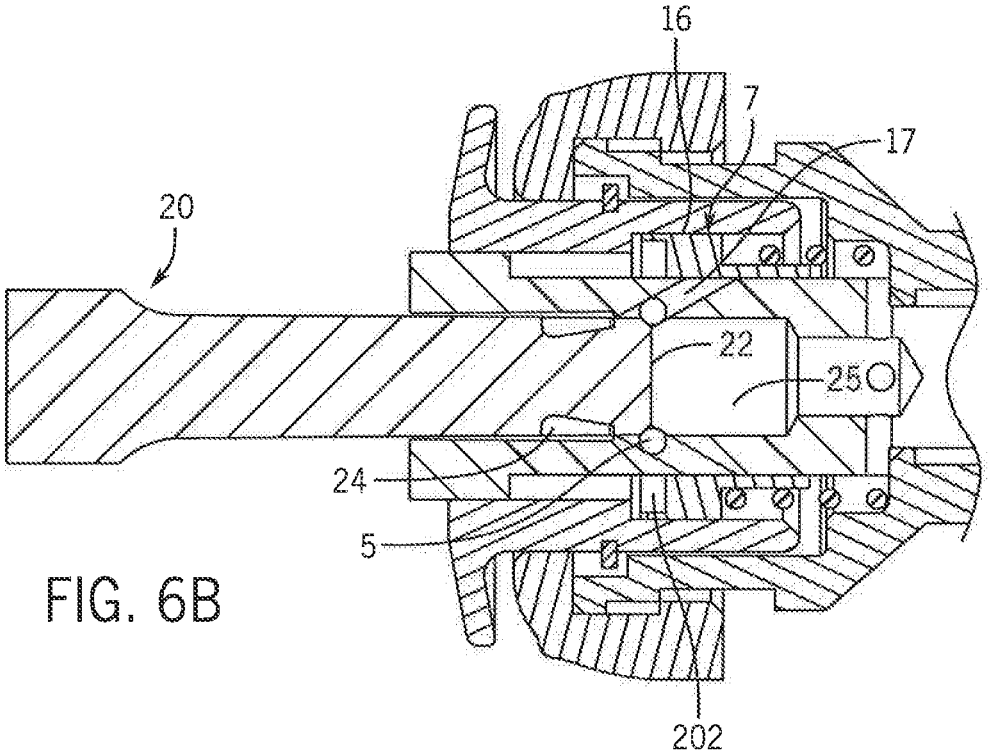
Figure 6C:
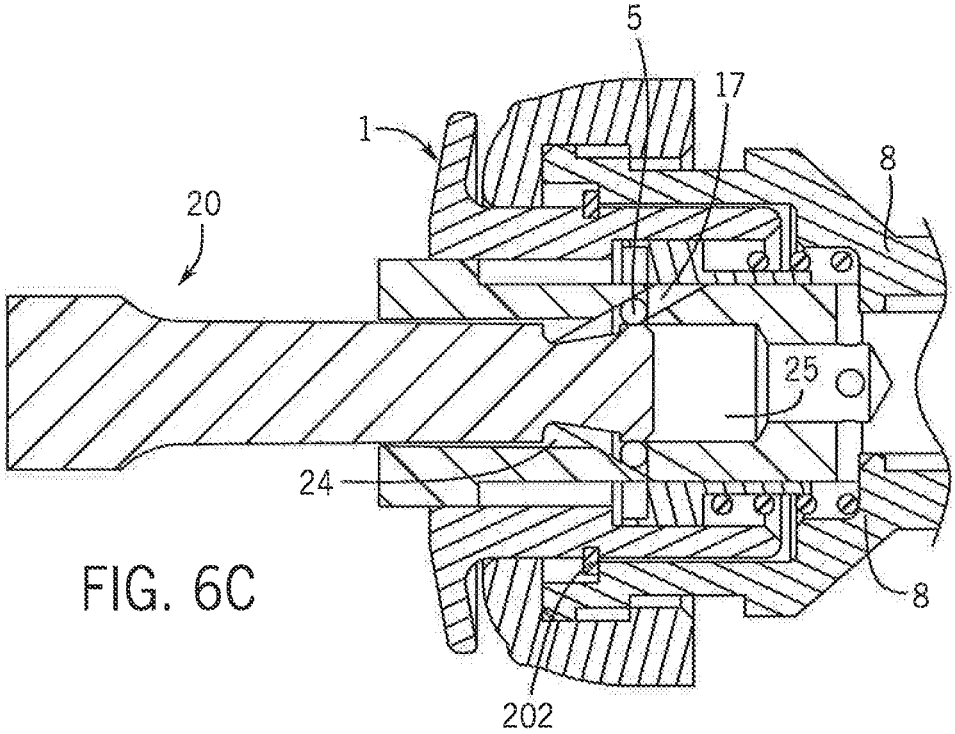
Figure 6D:
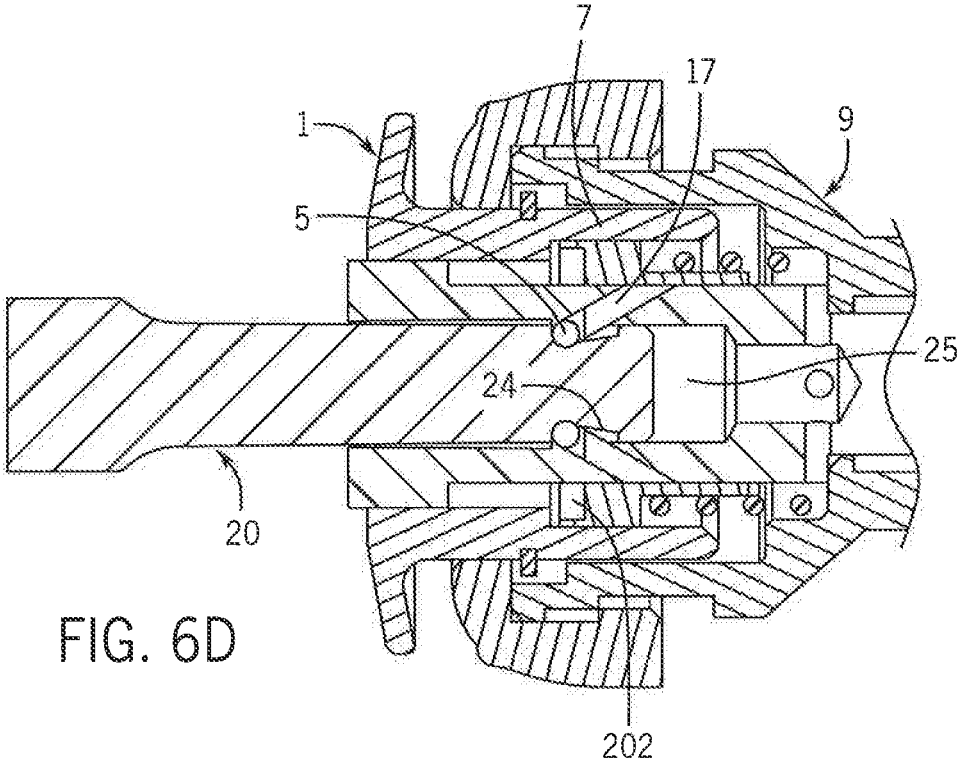

When a shaft 20 is inserted within the mechanism 13 using only a force exerted by the user along the shaft 20, as shown in FIGS. 4 and 6A-6D, a leading edge 22 of the shaft 20 contacts the pins 5 located in the slots 17 of the main body 4 (FIG. 6A). As the leading edge 22 is pressed inwardly and/or rotated into the mechanism 13, the pins 5 are moved laterally outwardly along the slots 17 and out of the path of the leading edge 22 of the shaft 20. This movement also compresses the ring shuttle 7 inwardly against the bias of the spring 8, assisting the movement of the pins 5 in the slots 17 (FIG. 6B) by allowing the pins to move radially outwardly along the circumferential slot 202. Once the pins 5 have moved sufficiently within the slots 17, 202 as a result of the movement of the ring shuttle 7 against the bias of spring 8 to allow the leading edge 22 of shaft 20 to pass between the pins 5 (FIG. 6C), the shaft 20 and leading edge 22 can be rotated with one hand to align flats (not shown) on the leading edge 22 with complementary alignment surfaces 28 on the interior surfaces of the bore 25 within the main body 4. Further, the movement of the shaft 20 within the main body 4 aligns the recesses 24 in the shaft 20 within the pins 5. This alignment enables the spring 8 to urge the ring shuttle 7 outwardly towards the cap 2, consequently moving the pins 5 along the slots 17 into the recesses 24 in the shaft 20 (FIG. 6D), thereby locking the shaft 20 within the mechanism 13 by the engagement of the recesses 24 with the exposed length of the pins 5.

The tolerance of the slots 17 is close to the diameter of the pins 5 such that the shaft 20 cannot significantly move relative to the main body 4 when the pins 5 are disposed within the recesses 24 as a result of the angular and constant pressure or force exerted on the tapered region of the shaft 20 via the pins 5 from the spring 8. In this configuration for the mechanism 13, the ring shuttle 7 and pins 5 can be displaced to secure the shaft 20 within the mechanism 13 by only having to press the shaft 20 into the mechanism 13 without having to simultaneously displace the collar 1. Further, as the pins 5 extend perpendicularly to the recesses 24, the pins 5 contact the recesses 24 along the entire length of the pin 5 exposed within the slots 17. As a result, the engagement of the pins 5 with the recesses 24 provides multiple, or an elongated area of contact between the mechanism 13 and the shaft 20 to more securely hold the shaft 20 within the handle 10.

Figure 5:
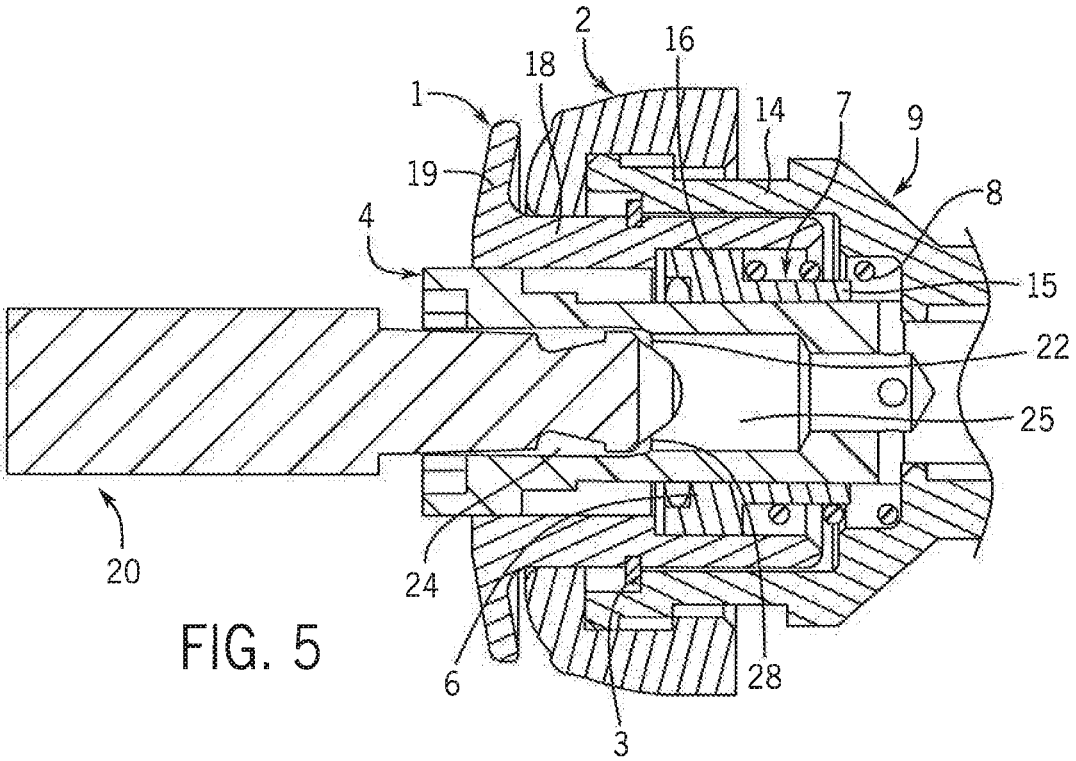
FIG. 5 is a cross-sectional view of a shaft securing mechanism constructed according to another exemplary embodiment of the invention.

Referring now to FIG. 5, in addition to the increased ease of engagement and significant reduction in the slop or play provided by the mechanism 13, in another illustrated exemplary embodiment the interior/bore 25 of the main body 4 is provided with a sloped or tapered surface 28. This surface 28 is operable to engage the leading edge 22 of the shaft in a gradual manner as the leading edge 22 contacts the surface 28 in order to align and center the leading edge 22 with the main body 4. Further, the proper engagement of the shaft 20 within the mechanism 13 is confirmed by the movement of the collar 1 forwardly from the handle 10 that provides a visual, audible and tactile indication of the engagement of the shaft 20 with the handle 10.

Various other embodiments of the present invention are contemplated as being within the scope of the filed claims particularly pointing out and distinctly claiming the subject matter regarded as the invention.

The invention claimed is:

1. A shaft securing system comprising:

a shaft securing mechanism comprising:

a) main body defining a central bore adapted to receive a shaft therein, the main body including at least one angled slot formed therein that intersects the bore at an inner end thereof;

b) at least one pin disposed within the angled slot and adapted to engage the shaft disposed within the bore; and c) at least one alignment structure formed on the bore to align the shaft within the bore, the at least one alignment structure consisting of an alignment surface formed as part of an inner surface of the bore, and a shaft inserted within the bore, wherein the shaft inserted within the bore includes a rounded leading edge including at least a portion shaped complementary to and engageable with the alignment surface of the bore, and a recess including an engagement surface formed with a sloped portion and flat stop portion oriented perpendicular to a long axis of the shaft, and within which the at least one pin is received.

2. The mechanism of claim 1 wherein the at least one pin is oriented within the slot perpendicularly to the length of the slot.

3. The mechanism of claim 2 further comprising a shuttle slidably disposed around the main body, the shuttle including a groove in which are disposed opposed ends of the at least one pin.

4. The mechanism of claim 3 further comprising a biasing member engaged with the shuttle and operable to urge the shuttle and the at least one pin along the at least one slot.

5. A handle comprising:

a) a core having an open end; and b) the shaft securing device of claim 1 disposed within the open end.

6. A method of securing a shaft to a handle, the method comprising the steps of:

a) providing the handle of claim 5; and b) inserting the shaft into the handle to engage the shaft securing device therein.

7. The method of claim 6 wherein the step of inserting the shaft does not require application of external force to the handle other than a force exerted along the shaft.

8. The method of claim 6 wherein the step of inserting the shaft comprises rotating the shaft relative to the main body.

9. A shaft securing system comprising:

a shaft securing mechanism comprising:

a) main body defining a central bore adapted to receive a shaft therein, the main body including at least one angled slot formed therein that intersects the bore at an inner end thereof;

b) at least one pin disposed within the angled slot and adapted to engage the shaft disposed within the bore; and c) an alignment structure formed on the bore to align the shaft within the bore, the alignment structure consisting of a tapered inner surface on an inner surface of the bore, and a shaft inserted within the bore, wherein the shaft inserted within the bore includes a rounded leading edge including at least a portion shaped complementary to and engageable with the alignment surface of the bore, and a recess including an engagement surface formed with a sloped portion and flat stop portion oriented perpendicular to a long axis of the shaft, and within which the at least one pin is received.

* * * * *